United States Patent [19]

Coutts et al.

[11] Patent Number: 4,793,609

[45] Date of Patent: Dec. 27, 1988

[54] EXERCISE DEVICE

[75] Inventors: David Coutts, Toronto; Amsey Buehler, Cobourg; James Bristow, Willowdale, all of Canada

[73] Assignee: Healthletics Inc., Scarborough, Canada

[21] Appl. No.: 915,562

[22] Filed: Oct. 6, 1986

[51] Int. Cl.[4] ..... A63B 21/02

[52] U.S. Cl. ..... 272/137; 272/140

[58] Field of Search ..... 272/67, 68, 74, 75, 272/93, 125, 126, 135–139, 141–143

[56] References Cited

U.S. PATENT DOCUMENTS

| | | | |
|---|---|---|---|
| 385,901 | 7/1888 | Barnett | 272/137 |
| 2,930,614 | 3/1960 | McIntosh | 272/137 |
| 3,256,015 | 6/1966 | Perrin | 272/137 X |
| 3,747,593 | 7/1973 | Taylor | 272/142 X |
| 4,059,265 | 11/1977 | Wieder et al. | 272/142 X |
| 4,195,835 | 4/1980 | Hinds et al. | 272/137 |
| 4,199,140 | 4/1980 | Ferretti | 272/142 X |
| 4,200,281 | 4/1980 | Wang | 272/138 |
| 4,251,071 | 2/1981 | Norton | 272/137 |
| 4,316,610 | 2/1982 | Hinds | 272/137 |
| 4,461,474 | 7/1984 | Retzlaff | 272/136 X |

FOREIGN PATENT DOCUMENTS

| | | | |
|---|---|---|---|
| 2630017 | 12/1978 | Fed. Rep. of Germany | 272/143 |
| 556672 | 12/1974 | Switzerland | 272/137 |

*Primary Examiner*—Richard J. Apley
*Assistant Examiner*—Robert W. Bahr

[57] ABSTRACT

An exercise device includes an elastic tube and a pair of elongate handles, each conveniently formed as a unitary member with no moving parts, integrally molded of a plastic. Each handle has a generally cylindrical outer surface and a pair of longitudinal slots formed internally of the outer surface in essentially spaced-apart, side-by-side relationship. The internal slots are dimensioned to grip the outer surface of the tube and have internal longitudinal ribs which enhance the gripping effect. A pair of transverse open-ended access slots are formed in the outer handle surface, each accessing one of the internal longitudinal slots to permit insertion and subsequent longitudinal displacement of the tube in the respective internal slot. An end of the tube is inserted transversely into one internal slot, wrapped through a 180 degree bend about a handle portion separating the internal slots, and then inserted transversely into the other longitudinal slot. Any tension in the elastic tube which initiates slippage of a tube end at one of the handles increases the frictional engagement of the tube end with the handle portion between the slots thereby increasing resistance to further slippage. The gripping action is sufficient that no additional clamping or holding mechanism is required to ensure that the exercise device does not come apart during use.

15 Claims, 1 Drawing Sheet

4,793,609

EXERCISE DEVICE

FIELD OF THE INVENTION

The invention relates generally to exercise devices, and more specifically, to devices in which an elastomeric member is retained between a pair of handles for repeated extension.

DESCRIPTION OF THE PRIOR ART

Exercise devices which involve repeated extension of elastomeric members are known. They generally comprise a pair of handles which are attached to the elastomeric member to permit a user to conveniently grip the device. Such devices are less expensive than weights, rowing equipment or other exercise devices, and have the added advantage of portability, particularly if the handles can be conveniently disengaged from the elastomeric member. A principal concern in the design of such exercisers is to provide appropriate means for securing the handles to the elastomeric member. Since the active element of the exerciser is elastomeric in nature it cannot be gripped as readily and as positively as might, for example, an equivalent steel spring. The securing means must avoid any slippage or disengagement of the handles from the elastic member, as this might potentially injure a user, but cannot grip the elastomeric member in a manner which causes damage or significant wear in the elastic member.

An early example of such an exerciser is described in Canadian Pat. No. 275,216 which issued on Nov. 8, 1927 to Roy H. Noe. In that exerciser, ends of an elastic belt are essentially clamped to a pair of handles. Each handle has threaded studs and an associated clamping bar with clearance holes which permit the clamping bar to be fitted about the studs. Butterfly nuts threaded on the studs are suggested as appropriate means for squeezing the belts between the clamping bars and the handles.

Another such exercise device is described in Canadian Pat. No. 368,113 which issued on May 26, 1936 to William Shenk. In the Shenk device, the elastomeric member is in the form of an endless belt, and a pair of detachable handles are provided. Each handle has hinged semi-circular halves which can be wrapped about the belt and a pin which can be passed through aligned sleeves or passages when the halves are closed to secure the handle to the belt.

Another exercise device involving an elastic cable is described in Canadian Pat. No. 1,153,032 which issued on Aug. 30, 1983 to Robert S. Hines. The cable is retained between a pair of handles each of which has a longitudinal hole and a pair of transverse holes positioned nearby. The gripping of the cable is said preferably to be achieved by passing an end of the cable through the longitudinal hole, then through one of the transverse holes and finally inserting the free cable end into the bight so formed. Such a device can be readily assembled and disassembled, but the hold which is maintained on the elastic member is not entirely satisfactory. There is a tendency in such devices for a handle to loosen suddenly from the elastic cable when tensioned with the attendant risk of a user striking himself.

Exercise devices such as those described in the Noe and Shenk patents have handles which potentially grip an elastomeric member in a secure manner. However, these handles involve moving parts which add to the expense of manufacture and which are not particularly convenient for the end user. Handles such as those described in the Hines patent are entirely passive devices with no moving parts and consequently comparatively inexpensive to manufacture; however, there is some question whether such devices grip elastomeric members in a satisfactory fashion and a user consequently have some reluctance to use such a device. It would be desirable to provide an exercise device of the general nature described above in which handles can be conveniently and inexpensively constructed with no moving parts but grip an elastomeric member reliably without causing damage or undue wear to the elastomeric member.

SUMMARY OF THE INVENTION

In one aspect, the invention provides an exercise device comprising at least one elastomeric member and a pair of handles which can releasably attached to the elastomeric member. Each handle has an outer surface which is preferably elongate and generally cylindrical in shape. A pair of longitudinal slots are formed in the handle internally of the outer surface in substantially side-by-side relationship. A first open-ended slot is formed in the outer surface to permit access to one of the longitudinal slots for insertion of a section of the elastomeric member. A second open-ended slot is formed in the external surface to permit insertion of the elastomeric member into the other longitudinal slot. Each of the longitudinal slots is dimensioned to grip the elastomeric member when received.

The elastomeric member is preferably in the form a length of hollow latex tube, although solid elastic cables and the like can be similarly retained by the handles. To attach the tube to one of the handles, a tube end portion is inserted through an access slot into one of the handle's longitudinal slots, wrapped about the handle structure separating the two longitudinal slots, and inserted through the other access slot into the handle's other longitudinal slot. The tube end is then gripped at two points along its length, and an intermediate section of the tube is wrapped about the handle portion separating the two longitudinal slots. The opposite tube end may be similarly retained by the other handle. Any tension in the elastic tube which initates slippage of a tube end at one of the handles increases the frictional engagement of the associated intermediate tube end section with the handle thereby increasing resistance to further slippage. The arrangement permits the construction of a handle which securely retains the elastic tube, which does not require any moving parts, and which can be designed, if desired, for convenient and inexpensive manufacture through injection molding.

Various advantages of exercisers constructed according to the invention and components therefor will be discussed below in connection with a description of a preferred embodiment. A number of inventive features apparent from the preferred embodiment are more specifically recited in the attached claims.

DESCRIPTION OF THE DRAWINGS

The invention will be better understood with reference to drawings illustrating a preferred embodiment of an exerciser, in which.

DESCRIPTION OF PREFERRED EMBODIMENT

Figure 3:
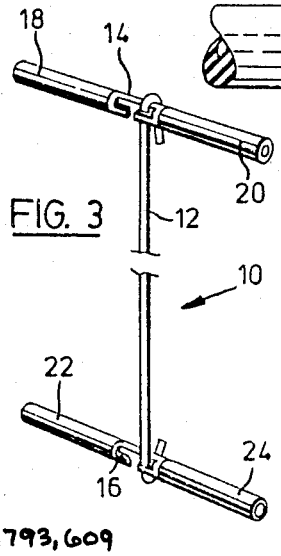
FIG. 3 is a perspective view of the exerciser (with four extension tubes) in a generally vertical orientation.
Figure 4:
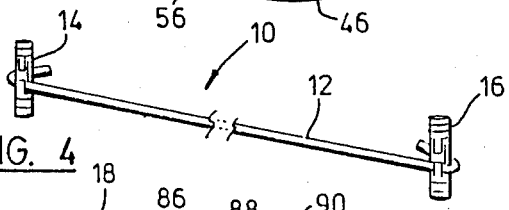
FIG. 4 is a perspective view of the exerciser in a horizontal orientation.
Figure 5:
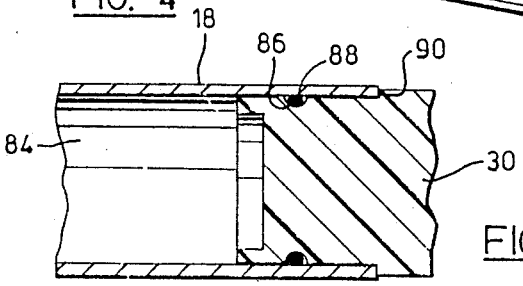
FIG. 5 is an enlarged cross-sectional view of the handle along the lines 5—5 of FIG. 1 detailing various the retention of one of the extension tubes.

Reference is made to FIG. 4 which illustrates an exerciser 10 comprising a latex tube 12 and a pair of elongate handles 14, 16 which serve to retain ends of the tube 12. In the orientation illustrated in FIG. 4, the handles 14, 16 might be separated by a user horizontally to exercise his pectoral muscles. The exerciser 10 is illustrated in a generally vertical orientation in FIG. 3 where a pair of extension conduits or tubes 18, 20 are shown attached to the handle 14, and another pair of extension conduits, 22, 24 are shown attached to the handle 16. In the orientation of FIG. 3, the upper extension tubes 18, 20 can be gripped by the user's hands and the lower extension tubes 22, 24 can be engaged by the user's feet to perform, for example, a curl exercise intended to develop a user's biceps. In practice, the lower extension tubes 22, 24 might be eliminated even for such exercises as the user can be many instances grip the handle 16 directly with his feet.

Figure 1:
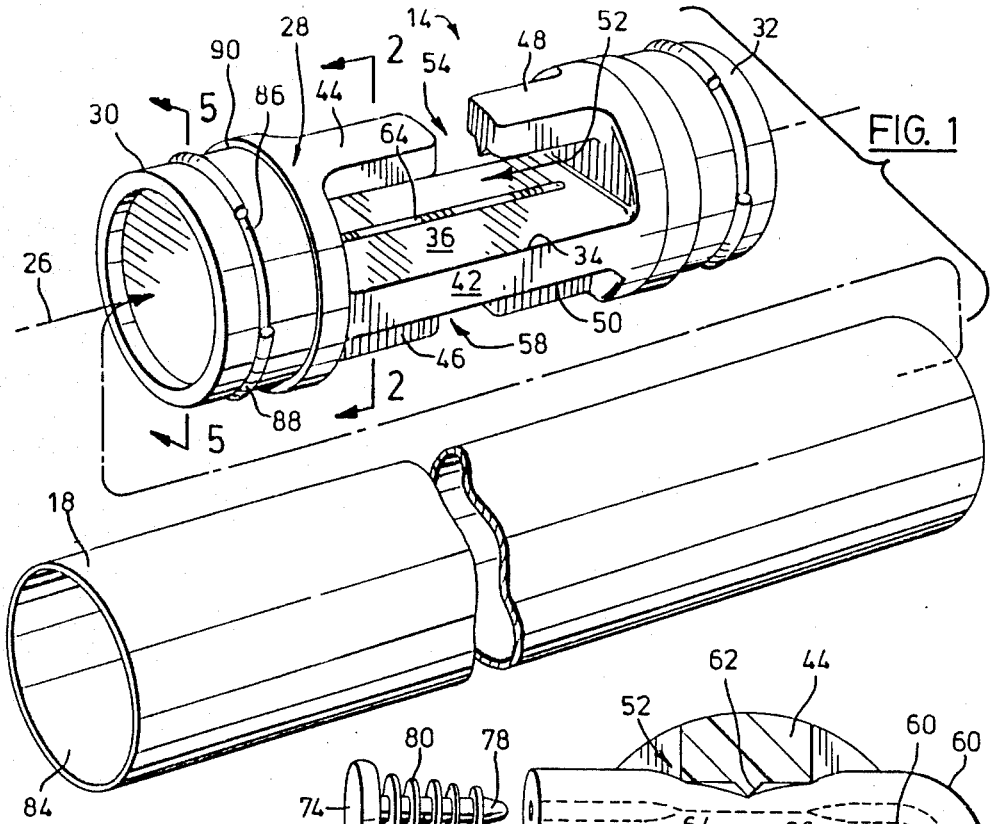
FIG. 1 is a partially exploded perspective view illustrating an exerciser handle and one tube (fragmented) which extends handle length.

The handle 14 which is typical of both handles is illustrated in FIG. 1. The handle 14 is integrally molded of a plastic such as a polypropylene, and has a longitudinal axis 26 (in this case a central axi) and an outer or external surface 28 formed around the axis 26 and having a generally cylindrical shape. The handle 14 has three major components: a pair of opposing, generally cylindrical, end portions 30, 32 and a generally plate-shaped intermediate handle portion 34 joining the handle end portions. The intermediate handle portion 34 will be seen in FIG. 2 to have a pair of opposing, generally planar faces 36, 38, and a pair of opposing, generally planar side edge surfaces 40, 42.

A first pair of longitudinally-directed fingers 44, 46 extend from the first handle portion 30 generally parallel to the intermediate handle portion 34. A similar pair of longitudinal fingers 48, 50 extend from the opposing handle portion 32 in similar relationship with the handle portion 34. The two fingers 44, 48 (which are axially aligned) together with the face 36 of the intermediate handle portion 34 define a first longitudinal slot 52 positioned internally of the outer handle surface 28. The fingers 46, 50 are spaced apart to define an open-ended transverse slot 54 in the outer handle surface 28 which accesses the interior of the longitudinal slot 52 and which is dimensioned to permit easy clearance of the tube 12 (and also tubes of larger external diameter for purposes described more fully below). The pair of fingers 46, 50 on the diametrically opposite side of the handle 14 together with the intermediate handle portion 34 similarly define another longitudinal slot 56, and between the fingers, a transverse open-ended slot 58 which accesses the longitudinal slot 56. It will be apparent that the longitudinal slots 56, 58 are essentially in side-by-side relationship, separated by the intermediate handle portion 34.

The structure of the handle 14 has been described in terms of a pair of distinct handle end portions, an intermediate handle portion and four fingers. These component have been viewed as defining the internal longitudinal slots and the access slots. The handle 14 may, however, be alternatively viewed as a generally cylindrical member in which a pair of longitudinal slots 52, 56 are formed internally of the outer surface 28 and a pair of transverse open-ended slots 54, 58 are formed in the outer surface to access the two internal slots 52, 56. The slots may be viewed as defining the various handle structures such as the longitudinal fingers and the intermediate handle portion. It will also be appreciated that if the transverse access slots are positioned adjacent ends of the longitudinal internal slots only a single pair of fingers or equivalent structure will be defined. Such structure are regarded as falling within the ambit of the present invention, although the four finger arrangement is preferred as an additional elastic tube may be very conveniently retained, each under distinct fingers, to increase the force required to separate the handles without requiring a tube to be longitudinally displaced a great distance along the internal slots for proper retention.

Figure 2:
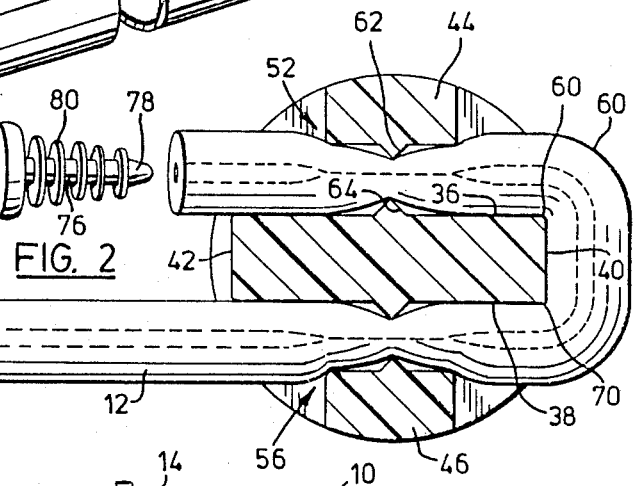
FIG. 2 is a cross-sectional view along the lines 2—2 of FIG. 1 illustrating how the handles retains an elastic tube.

The manner in which the tube 12 is retained by the handles will best be understood with reference to FIG. 2. To arrive at the orientation illustrated in FIG. 2, the tube end portion 60 is first inserted through the access slot 54 into the interior of the longitudinal slot 52 and displaced axially to secure the tube end portion 60 between the finger 44 and the face 36 of the intermediate handle portion 34. The tube end portion 60 is then wrapped about the intermediate handle portion 34, being bent through a full 180 degrees in the process, and then inserted in a similar manner through the other access slot 58 into the corresponding longitudinal slot 56 for retention under the finger 46. The spacing between the finger 44 and the face 36 of the intermediate handle portion (and also between the finger 46 and the face 38) is preselected to be substantially the difference between the outer and inner diameters of the latex tube (alternatively viewed, twice the tube wall thickness). Accordingly, the latex tube is snugly received between the finger 44 and intermediate handle portion 34 and compressed until substantially flat. To ensure positive gripping of the tube end portion 60, the finger 44 is provided with a longitudinal rib or tooth 62 which extends into the interior of the longitudinal slot 56 and the outer face 36 of the intermediate handle portion similarly defines a longitudinal rib 64, substantially coplanar with the rib 62. The other fingers and the opposing face 38 of the intermediate handle portion are similarly formed with longitudinal ribs that enhance gripping of the tube 12. To further enhance gripping of the tube, the side edge surfaces 40, 42 may optionally be formed with longitudinal ribs (not illustrated), at least one of these ribs being engaged with the exterior of the latex tube 12 at any time.

A number of matters regarding gripping of the tube end portion 60 should be noted. First, as apparent in FIG. 2, the tube end portion 60 is gripped in both longitudinal slots 52, 56 thereby doubling the basic gripping force applied to the tube. Second, during normal extension of the tube 12 during exercise, any slippage apt to occur will first manifest itself at the finger 46 or alternatively viewed at the slot 56. This slippage increases the tension in the tube section between the fingers 44, 46 (wrapped about the intermediate handle portion 34) causing the tube section to engage the intermediate handle portion 34 more tightly. The tube section consequently applies a greater normal force into the side edge surface 40 of the intermediate handle portion 34 (and to some extent into the opposing faces 36, 38 of the intermediate hand portion 34) thereby increasing frictional forces between the tube 12 and the handle 14 which tend to resist further slippage. It will be apparent that these frictional forces tend to increase in proportion to the amount of slippage occurring or the tension ultimately applied to the wrapped tube section, an effect contributing markedly to the positive retention of the tube 12. An additional factor resisting slippage is believed to be the manner in which the tube 12 is bent about the side edge 40 of the intermediate handle portion 34. It will be apparent from FIG. 2 that each of the side edges 40, 42 meets each of the opposing faces 36, 38 at substantially a right angle. This arrangement might be contrasted for example with the provision of semicircular surfaces at the side edges of the intermediate handle portion 34. Slippage of the tube 12 relative to the handle 14 consequently requires significant and continuous deformation of the tube end 60 about the two right-angled corners 68, 70. Such deformation requires some force and accordingly resists slippage. It is not entirely certain to what extent this effect adds to the gripping provided by the handles.

Although the handles 14 would be appropriate for retention of a solid elastic cable or one of irregular shape, the design of the handle 14 is singularly advantageous for use with a tubular elastomeric member such as the latex tube 12 which has predetermined inner and outer diameters. As mentioned above, the spacing between each of the handle fingers and the adjacent face of the intermediate handle portion 34 (the width of the associated longitudinal slot) is substantially twice the thickness of the tube wall (the difference between the outer and inner diameters of the tube 12 or twice the difference between the outer and inner radii). To increase the amount of force required to separate the handles 14, 16, it is only necessary to substitute a latex tube (assumed to be made of a similar material having the same Young's modulus) of larger outer diameter, but the same wall thickness. Such a tube may still be inserted snugly in each of the longitudinal slots 52, 56 and predictably retained, the tube simply expanding laterally more than the tube 12, but ultimately compressing in each longitudinal slot into a structure with a fixed thickness, twice the predetermined wall thickness.

Optionally, retention of the tube end 60 may be further ensured by inserting a plastic plug 72 into its open end. The plug 72 (illustrated in FIG. 2) has a head 74 and a tapered shaft 76, which is thickest adjacent the head 74 (in excess of the inner diameter of the tube 12) and thinnest adjacent a free shaft end 78 (less than the inner diameter of the tube 12). The shaft 76 is constructed as a number of separate disk-shaped members (such as the disk 80). These disk-shaped members tend to embed themselves in the internal surface of the tube 12 as the tube is stretched in response to slippage of the tube end portion 60 at the finger 44. tubing used to construct the extension tube 18. To further ensure proper seating of the extension tube 18 on the handle 14, paired recesses and O-rings may be provided in the handle end portion 30, although this arrangement has not be illustrated. An annular abutment shoulder 90 of slightly larger diameter than the cylindrical outer surface 82 of the handle end portion 30 ensures proper location of the extension tube 18 relative to the handle end portion 30.

Those skilled in the construction of such exercise devices will now be aware of the principal advantages of the exerciser 10. First, each handles may be conveniently and inexpensively constructed as unitary member by injection molding of a plastic. Second, no moving parts are required to ensure positive retention of the elastic tube 12, and the gripping arrangement will not stress the tube 12 at any particular point in such a manner as to cause premature wear of the tube. Third, the exerciser 10, including extension handles, can be conveniently disassembled and stored in compact form in a gym bag or the like.

The handles of the exerciser might be constructed with only a single longitudinal slot and associated open-ended access slot. For example, with reference to the handle 14 of FIG. 1, the second longitudinal slot 56 and corresponding access slot 58 might be eliminated. The resultant handle would still be capable of retaining the tube end portion 60 and would represented a simple structure with no moving parts that could be readily molded as a unitary member of a suitable plastic. The twin longitudinal slot construction characteristic of the handle 14 is preferred as the principles of gripping inherent in such an arrangement (described above) provide for positive and reliable retention of an elastomeric member. A handle with three or more longitudinal slots each associated with an open-ended access slot might be considered, and would embody such gripping principles, but the twin slot arrangement is preferred for simplicity of molding and use.

It will be appreciated that a particular embodiment of the invention has the tube end portion 60 and would represent a simple structure with no moving parts that could be readily molded as a unitary member of a suitable plastic. The twin longitudinal slot construction characteristic of the handle 14 is preferred as the principles of gripping inherent in such an arrangement (described above) provide for positive and reliable retention of an elastomeric member. A handle with three or more longitudinal slots each associated with an open-ended access slot might be considered, and would embody such gripping principles, but the twin slot arrangement is prefrred for simplicity of molding and use.

It will be appreciated that a particular embodiment of the invention has been illustrated and that the extact features of this exerciser should not be regarded as restricting the scope of the invention or the appended claims.

We claim:

1. An exercise comprising:

an elastomeric member;

a pair of elongate handles, each handle having (a) a longitudinal axis;

(b) an outer surface around the longitudinal axis dimensioned to be gripped in a person's hand;

(c) a longitudinal slot formed internally of the outer surface;

(d) an open-ended slot formed in the outer surface and accessing the longitudinal slot, the open-ended slot being dimensioned to permit insertion of the elastomeric member into the longitudinal slot;

(e) a pair of opposing handle end portions;

(f) an intermediate handle portion connecting the opposing handle end portions;

(g) a pair of longitudinally-directed, axially-aligned fingers, one of the fingers being attached to one of the pair of opposing handle end portions, the other of the fingers being attached to the other of the pair of opposing handle end portions, the pair of fingers and the intermediate handle portion defining at least in part the longitudinal slot, the pair of fingers being spaced-apart to define the open-ended slot, the separation between each of the fingers and the intermediate handle portion being such that the elastomeric member is gripped when inserted through the open-ended slot into the longitudinal slot and located between either of the fingers and the intermediate handle portion.

2. An exercise device as claimed in claim 1 which for each handle:

the intermediate handle portion has a face confronting the pair of fingers and formed with a longitudinal rib; and, each of the pair of fingers has a longitudinal rib extending into the longitudinal slot.

3. An exercise device as claimed in claim 2 in which each of the handles is integrally molded of a plastic.

4. An exercise device comprising:

an elastomeric member;

a pair of elongate handles, each handle having (a) a longitudinal axis (b) an outer surface around the longitudinal axis dimensioned to be gripped in a person's hand;

(c) a first longitudinal slot formed internally of the outer surface;

(d) a second longitudinal slot formed internally of the outer surface in side-by-side relationship with the first longitudinal slot;

(e) a first open-ended slot formed in the outer surface and accessing the first longitudinal slot, the first open-ended slot being dimensioned to permit insertion of the elastomeric member into the first longitudinal slot;

(f) a second open-ended slot formed in the outer surface and accessing the second longitudinal slot, the second open-ended slot being dimensioned to permit insertion fo the elastomeric member into the first longitudinal slot;

(f) a second open-ended slot formed in the outer surface and accessing the second longitudinal slot, the second open-ended slot being dimensioned to permit insertion of the elastomeric member into the second longitudinal slot;

(g) a pair of opposing handle end portions;

(h) an intermediate handle portion connecting the opposing handle end portions;

(i) first and second longitudinally-directed fingers attached to one of the pair of opposing handle end portions and extending substantially parallel to the intermediate handle portion, the first finger and the intermediate handle portion defining at least in part the first longitudinal slot, the second finger and the intermediate handle portion defining at least in part the second longitudinal slot, the separation between each of the fingers and the intermediate handle portion being such that each of the first and second longitudinal slots grips the elastomeric member when the elastomeric member is inserted into the longitudinal slot through the associated open-ended slot and located between the associated finger and the intermediate handle portion.

5. An exercise device as claimed in claim 4 in which the intermediate handle portion has an opposing pair of faces which define at least in part the first and second longitudinal slots, and an opposing pair of longitudinally-directed side edge surfaces, each of the pair of side edge surfaces extending between the pair of planar faces and meeting each of the pair of planar faces at substantially a right angle.

6. An exercise device as claimed in claim 4 in which:

the elastomeric member has a tubular shape with a predetermined inner diameter and a predetermined outer diameter; and, the separation between the first and second fingers is substantially the difference between the outer and inner diameters of the elastomeric member.

7. An exercise device as claimed in claim 6 comprising at least one plug removably insertable into an end of the elastomeric member, the plug having a head and a tapered shaft attached to the head, the shaft having an outer diameter adjacent the head which is larger than the inner diameter of the elastomeric member and having an outer diameter distant from the head which is less than the inner diameter of the elastomeric member.

8. An exercise device as claimed in claim 4 in which for each handle:

the intermediate handle portion is a generally plate-shaped member having first and second opposing faces, the first face confronting the first finger, the second face confronting the second finger, each of the first and second faces being formed with a longitudinal rib; and, each of the first and second fingers has a longitudinal rib extending respectively into the first and second longitudinal slots.

9. An exercise device as claimed in claim 4 in which:

the opposing end portions of at least one of the handles have a generally cylindrical shape;

the one of the handles has associated therewith a pair of tubular extension members, each extension member being dimensioned to slide over and to be closely and releasably received by one of the handle end portions.

10. An exercise device as claimed in claim 9 in which each of the opposing handle end portions of the one handle has an annular recess and a resilient O-ring seated in the recess for engaging the inner surface of the associated one of the tubular extension members.

11. An exercise device as claimed in claim 4 in which each handle is integrally formed of a plastic and the outer surface of each handle is generally cylindrical in shape.

12. An exercise device comprising:

an elastomeric member;

a pair of elongate handles, each handle having (a) a longitudinal axis (b) an outer surface around the longitudinal axis dimensioned to be gripped in a person's hand;

(c) a first longitudinal slot formed internally of the outer surface;

(d) a second longitudinal slot formed internally of the outer surface in side-by-side relationship with the first longitudinal slot;

(e) a first open-ended slot formed in the outer surface and accessing the first longitudinal slot, the first open-ended slot being dimensioned to permit insertion of the elastomeric member into the first longitudinal slot;

(f) a second open-ended slot formed in the outer surface and accessing the second longitudinal slot, the second open-ended slot being dimensioned to permit insertion fo the elastomeric member into the first longitudinal slot;

(f) a second open-ended slot formed in the outer surface and accessing the second longitudinal slot, the second open-ended slot being dimensioned to permit insertion of the elastomeric member into the second longitudinal slot;

(g) a pair of opposing handle end portions;

(h) an intermediate handle portion connecting the opposing handle end portions;

(i) a first pair of longitudinally-directed fingers generally parallel to the intermediate handle portion, one of the first pair of fingers being attached to one of the opposing handle end portions, the other of the first pair of fingers being attached to the other of the opposing handle end portions, the first pair of fingers being aligned and spaced to define the first open-ended slot, the first pair of fingers together with the intermediate handle portion defining the first longitudinal slot;

(j) a second pair of longitudinally-directed fingers generally parallel to the intermediate handle portion, one of the second pair of fingers being attached to the one of the opposing handle end portions, the other of the second pair of fingers being attached to the other of the opposing handle end portions, the second pair of fingers being aligned and spaced to define the second open-ended slot, the second pair of fingers together with the intermediate handle portion defining the second longitudinal slot;

(h) each of the longitudinal slots being shaped to grip the elastomeric member when inserted into the slot through the respective one of the first and second open-ended slots.

13. An exercise device as claimed in claim 12 in which for each handle the intermediate handle portion has a opposing pair of planar faces which define at least in part the first and second longitudinal slots and an opposing pair of longitudinally-directed, planar side edge surfaces, each of the pair of side edge surfaces extending between the pair of planar faces and meeting each of the pair of planar faces at substantially a right angle.

14. An exercise device as claimed in claim 12 in which for each handle:

the intermediate handle portion is a generally plate-shaped member having first and second opposing faces, the first face confronting the first finger, the second face confronting the second finger, each of the first and second faces being formed with a longitudinal rib;

each of the first pair of fingers has a longitudinal rib extending into the first longitudinal slot; and, each of the second pair of fingers has a longitudinal rib extending into the second longitudinal slot.

15. An exercise device as claimed in claim 12 in which each handle is integrally form of a plastic and the outer surface of each handle is generally cylindrical in shape.

* * * * *